US008028365B2

(12) United States Patent
Field

(10) Patent No.: US 8,028,365 B2
(45) Date of Patent: Oct. 4, 2011

(54) HARD AND SOFT FLOOR CLEANING TOOL AND MACHINE

(75) Inventor: Bruce F. Field, Golden Valley, MN (US)

(73) Assignee: Tennant Company, Minneapolis, MN (US)

( * ) Notice: Subject to any disclaimer, the term of this patent is extended or adjusted under 35 U.S.C. 154(b) by 1117 days.

(21) Appl. No.: 11/371,111

(22) Filed: Mar. 8, 2006

(65) Prior Publication Data

US 2006/0150352 A1 Jul. 13, 2006

Related U.S. Application Data

(63) Continuation-in-part of application No. 10/653,347, filed on Sep. 2, 2003, now abandoned, and a continuation-in-part of application No. 10/749,129, filed on Dec. 30, 2003, now abandoned.

(60) Provisional application No. 60/660,820, filed on Mar. 11, 2005.

(51) Int. Cl.
*A47L 11/282* (2006.01)
*A47L 11/283* (2006.01)

(52) U.S. Cl. ..... 15/98; 15/230.14; 15/230.16

(58) Field of Classification Search ..... 15/98, 230.14, 15/230.16, 97.3
See application file for complete search history.

(56) References Cited

U.S. PATENT DOCUMENTS 2,039,677 A * 5/1936 Brooks ..... 15/230.14
2,211,716 A * 8/1940 Fallon ..... 15/93.1
2,407,408 A * 9/1946 Erickson ..... 15/320
2,455,680 A * 12/1948 Kaplan ..... 15/230.16
2,522,092 A * 9/1950 Churchill ..... 15/230.14
2,563,151 A 8/1951 Bjorksten
2,731,659 A 12/1952 Coplen
3,037,887 A 5/1959 Brenner et al.
2,993,494 A 7/1961 Svensson
3,008,277 A * 11/1961 Schloss ..... 15/230.14
3,078,190 A 2/1963 Blaser et al.
3,162,427 A 12/1964 Knudson et al.
3,212,762 A 10/1965 Carroll et al.
3,231,134 A 1/1966 Webster
3,392,418 A 7/1968 Schowalter
3,407,425 A 10/1968 Drumm
3,436,262 A 4/1969 Crowe et al.

(Continued)

FOREIGN PATENT DOCUMENTS

CN 2147823 Y 12/1993

(Continued)

OTHER PUBLICATIONS

A first Office Action in corresponding Chinese patent application No. 200680007922.9 dated Jul. 3, 2009.

(Continued)

*Primary Examiner* — Randall Chin
(74) *Attorney, Agent, or Firm* — Westman, Champlin & Kelly, P.A.

(57) ABSTRACT

A cleaning tool generally comprises a hub having a longitudinal axis and a plurality of cleaning members. The cleaning members, formed of a fibrous material, are connected to the hub. In accordance with one embodiment, the cleaning members are distributed along the longitudinal axis. Also disclosed is a floor cleaning machine that includes a mobile body, the cleaning tool and a motor. The mobile body supports the cleaning tool and the motor and is configured to travel over a surface. The motor is configured to drive a rotation of the cleaning hub about the longitudinal axis.

12 Claims, 8 Drawing Sheets

U.S. PATENT DOCUMENTS 3,453,678 A 7/1969 Gehman et al.
3,456,279 A 7/1969 Koland
3,460,717 A 8/1969 Thomas
3,490,948 A 1/1970 Farison
3,535,162 A 10/1970 Bray et al.
3,549,420 A 12/1970 Cunningham
3,655,096 A 4/1972 Easter
3,676,889 A 7/1972 Edlin
3,761,987 A 10/1973 Nayfa et al.
3,774,262 A 11/1973 Anthony et al.
3,789,449 A 2/1974 MacFarland et al.
3,823,727 A 7/1974 Fry
3,931,662 A 1/1976 Nayfa et al.
3,938,212 A 2/1976 Krier et al.
3,940,826 A 3/1976 Phillips et al.
3,942,218 A 3/1976 Krier et al.
3,974,541 A 8/1976 Silvis et al.
3,979,789 A 9/1976 Peabody et al.
4,000,536 A 1/1977 Nayfa et al.
4,014,808 A 3/1977 Herpers, Jr. et al.
4,032,307 A 6/1977 Sommerfeld
4,037,289 A 7/1977 Dojan
D245,994 S 10/1977 Olson
4,061,001 A 12/1977 Von der Eltz et al.
4,096,084 A 6/1978 Thomsen et al.
4,099,285 A 7/1978 Christensen et al.
4,107,075 A 8/1978 Kramer
4,133,773 A 1/1979 Simmons
4,138,756 A 2/1979 Krier et al.
RE29,957 E 4/1979 Kasper
4,167,798 A 9/1979 Kltigl et al.
4,167,799 A 9/1979 Webb
4,173,056 A 11/1979 Geyer
4,176,420 A 12/1979 Magid
4,191,590 A 3/1980 Sundheim
4,194,263 A 3/1980 Herpers et al.
4,206,530 A 6/1980 Kroll et al.
4,210,978 A 7/1980 Johnson et al.
D257,845 S 1/1981 Peabody et al.
4,258,451 A 3/1981 Sommerfeld
4,262,382 A 4/1981 Brown et al.
4,295,244 A 10/1981 Herpers et al.
4,310,944 A 1/1982 Kroll et al.
4,320,556 A 3/1982 Kimzey et al.
4,334,335 A 6/1982 Brown et al.
4,345,353 A 8/1982 Sommerfeld
4,346,494 A 8/1982 Peabody et al.
4,348,783 A 9/1982 Swanson et al.
4,355,435 A 10/1982 Kimzey et al.
4,365,189 A 12/1982 Hawkins et al.
4,369,544 A 1/1983 Parisi
D267,824 S 2/1983 Mannelly
4,373,227 A 2/1983 Kimzey et al.
4,377,017 A 3/1983 Herpers et al.
4,378,855 A 4/1983 Haub et al.
4,393,538 A 7/1983 Olson
4,419,141 A 12/1983 Kunkel
4,429,432 A 2/1984 Copeland et al.
D273,620 S 4/1984 Kimzey et al.
D273,621 S 4/1984 Haub et al.
D273,622 S 4/1984 Brown et al.
4,457,036 A 7/1984 Carlson et al.
4,511,486 A 4/1985 Shah
4,557,739 A 12/1985 Fortman et al.
4,570,278 A * 2/1986 Bloome et al. ..... 15/97.1
4,570,856 A 2/1986 Groth et al.
4,571,771 A 2/1986 Worwa
4,577,364 A * 3/1986 Demetriades ..... 15/320
4,580,313 A 4/1986 Blehert
4,586,208 A 5/1986 Trevarthen
4,595,420 A 6/1986 Williams, III et al.
4,608,086 A 8/1986 Dodge
4,615,070 A 10/1986 Frederick et al.
4,624,026 A 11/1986 Olson et al.
4,634,403 A 1/1987 Peabody et al.
4,667,364 A 5/1987 Meili
4,675,935 A 6/1987 Kasper et al.
4,676,287 A 6/1987 Fitzwater
4,676,926 A 6/1987 Kappler
4,679,271 A 7/1987 Field et al.
4,709,771 A 12/1987 Basham et al.
4,729,141 A 3/1988 Berg et al.
4,757,566 A 7/1988 Field et al.
4,768,311 A 9/1988 Olson
4,780,243 A 10/1988 Edgley et al.
4,805,256 A 2/1989 Mason et al.
4,805,258 A 2/1989 Sitarski et al.
4,817,233 A 4/1989 Waldhauser
4,819,676 A 4/1989 Blehert et al.
4,822,431 A 4/1989 Bricher et al.
4,838,457 A 6/1989 Swahl et al.
4,849,027 A 7/1989 Simmons
4,866,804 A 9/1989 Masbruch et al.
4,881,288 A 11/1989 May et al.
4,903,718 A 2/1990 Sullivan
4,913,316 A 4/1990 Richter
4,967,064 A 10/1990 Field et al.
4,974,618 A 12/1990 Nysted
4,986,378 A 1/1991 Kasper
4,996,468 A 2/1991 Field et al.
5,013,333 A 5/1991 Beaufoy et al.
5,016,310 A 5/1991 Geyer et al.
5,031,837 A 7/1991 Hanish
5,044,043 A 9/1991 Basham et al.
5,045,118 A 9/1991 Mason et al.
5,060,342 A 10/1991 Brazier
5,064,010 A 11/1991 Mashbruch et al.
5,088,149 A 2/1992 Berg et al.
5,093,955 A 3/1992 Blehert et al.
RE33,926 E 5/1992 Waldhauser
5,116,425 A 5/1992 Ruef
5,127,123 A * 7/1992 Belanger ..... 15/53.4
5,133,107 A 7/1992 MacDonald
5,148,569 A * 9/1992 Jailor et al. ..... 15/41.1
5,207,642 A 5/1993 Orkin et al.
5,212,848 A 5/1993 Geyer
5,213,120 A 5/1993 Dickson
5,231,725 A 8/1993 Hennessey et al.
5,244,003 A 9/1993 Boomgaarden
5,254,146 A 10/1993 Beaufoy
5,276,933 A 1/1994 Hennessey et al.
5,295,277 A 3/1994 Koenigs et al.
5,303,448 A 4/1994 Hennessey et al.
5,319,828 A 6/1994 Waldhauser et al.
5,375,289 A * 12/1994 Miyaoka ..... 15/230
5,383,605 A 1/1995 Teague
RE35,033 E 9/1995 Waldhauser
5,455,985 A 10/1995 Hamline et al.
5,462,607 A 10/1995 Mestetsky et al.
5,483,718 A 1/1996 Blehert et al.
5,509,972 A 4/1996 Akazawa et al.
5,515,568 A 5/1996 Larson et al.
5,526,547 A 6/1996 Williams et al.
5,566,422 A 10/1996 Geyer
5,593,091 A 1/1997 Harris
5,647,093 A 7/1997 Engel et al.
5,649,643 A 7/1997 Ridgeway
5,657,504 A * 8/1997 Khoury ..... 15/98
5,659,921 A 8/1997 Narayan
5,711,775 A 1/1998 Field et al.
5,735,017 A 4/1998 Barnes et al.
5,738,248 A 4/1998 Green
5,784,748 A * 7/1998 Belanger et al. ..... 15/230.14
5,804,274 A 9/1998 Nordin
5,813,086 A 9/1998 Ueno et al.
5,816,298 A 10/1998 Stricklin et al.
5,829,094 A 11/1998 Field et al.
5,836,045 A 11/1998 Anthony et al.
5,853,814 A 12/1998 Murphy
5,871,152 A 2/1999 Saney
5,884,353 A 3/1999 Berg et al.
5,893,189 A 4/1999 D'Costa
5,896,617 A 4/1999 Kasen et al.
5,901,407 A 5/1999 Boomgaarden
5,940,928 A 8/1999 Erko
5,940,929 A 8/1999 Berg
5,943,724 A 8/1999 Erko et al.

| | | | | |
|---|---|---|---|---|
| 5,943,730 | A | 8/1999 | Boomgaarden | |
| 5,967,747 | A | 10/1999 | Burke et al. | |
| 5,983,447 | A | 11/1999 | Boomgaarden | |
| 5,991,953 | A | 11/1999 | Durenberger et al. | |
| 5,996,173 | A | 12/1999 | Engel et al. | |
| 5,996,174 | A | 12/1999 | Boomgaarden et al. | |
| 6,003,186 | A | 12/1999 | Larson | |
| 6,017,163 | A | 1/2000 | Keppers | |
| 6,018,844 | A | 2/2000 | Basham et al. | |
| 6,035,479 | A | 3/2000 | Basham et al. | |
| 6,067,685 | A * | 5/2000 | Holbus | 15/230.15 |
| 6,073,295 | A | 6/2000 | Durenberger et al. | |
| 6,090,217 | A | 7/2000 | Kittle | |
| 6,092,261 | A | 7/2000 | Boomgaarden | |
| 6,117,200 | A | 9/2000 | Berg et al. | |
| 6,125,495 | A | 10/2000 | Berg et al. | |
| 6,131,766 | A | 10/2000 | King et al. | |
| 6,167,587 | B1 | 1/2001 | Kasper et al. | |
| 6,192,542 | B1 | 2/2001 | Frederick et al. | |
| 6,202,243 | B1 | 3/2001 | Beaufoy et al. | |
| 6,206,980 | B1 | 3/2001 | Robinson | |
| 6,209,756 | B1 | 4/2001 | Van Der Heijden | |
| 6,249,926 | B1 | 6/2001 | Wulff | |
| 6,276,613 | B1 | 8/2001 | Kramer | |
| 6,283,221 | B2 | 9/2001 | Hurray et al. | |
| 6,286,169 | B1 | 9/2001 | D'Costa et al. | |
| 6,295,687 | B1 * | 10/2001 | Dehart | 15/181 |
| 6,389,641 | B1 | 5/2002 | Boomgaarden et al. | |
| 6,398,829 | B1 | 6/2002 | Shinler et al. | |
| 6,401,294 | B2 | 6/2002 | Kasper | |
| 6,418,586 | B2 | 7/2002 | Fulghum | |
| 6,421,870 | B1 | 7/2002 | Basham et al. | |
| 6,425,958 | B1 | 7/2002 | Giddings et al. | |
| 6,428,590 | B1 | 8/2002 | Lehman et al. | |
| 6,438,793 | B1 | 8/2002 | Miner et al. | |
| 6,449,793 | B2 | 9/2002 | D'Costa et al. | |
| 6,505,379 | B2 | 1/2003 | Keller | |
| 6,507,968 | B1 | 1/2003 | Hansen | |
| 6,523,992 | B1 | 2/2003 | Bublewitz et al. | |
| 6,530,102 | B1 | 3/2003 | Pierce et al. | |
| 6,532,619 | B2 * | 3/2003 | Kasper et al. | 15/320 |
| 6,543,580 | B1 | 4/2003 | Gathmann et al. | |
| 6,571,423 | B1 | 6/2003 | Lijzenga et al. | |
| 6,585,827 | B2 | 7/2003 | Field et al. | |
| 6,602,018 | B2 | 8/2003 | Feeny et al. | |
| 6,614,195 | B2 | 9/2003 | Bushey et al. | |
| 6,618,888 | B2 | 9/2003 | Joynt et al. | |
| 6,647,585 | B1 | 11/2003 | Robinson | |
| 6,651,286 | B2 | 11/2003 | Pierce | |
| 6,658,692 | B2 | 12/2003 | Lenkiewicz et al. | |
| 6,662,402 | B2 | 12/2003 | Giddings et al. | |
| 6,662,600 | B1 | 12/2003 | Field et al. | |
| D485,175 | S | 1/2004 | Field et al. | |
| 6,671,925 | B2 | 1/2004 | Field et al. | |
| 6,705,332 | B2 | 3/2004 | Field et al. | |
| 6,733,861 | B1 * | 5/2004 | Belanger | 428/114 |
| 6,735,811 | B2 | 5/2004 | Field et al. | |
| 6,735,812 | B2 | 5/2004 | Hekman et al. | |
| 6,742,219 | B2 | 6/2004 | Lenzmeier et al. | |
| 6,795,995 | B1 | 9/2004 | Holbus | |
| 6,802,098 | B2 | 10/2004 | Geyer et al. | |
| 6,836,919 | B2 | 1/2005 | Shinler | |
| 6,877,180 | B2 | 4/2005 | Wilmo et al. | |
| 6,880,199 | B1 | 4/2005 | Huffman et al. | |
| 6,893,180 | B2 | 5/2005 | Hall et al. | |
| 6,945,261 | B2 | 9/2005 | Wadsworth et al. | |
| 7,197,786 | B2 * | 4/2007 | Holbus | 15/230 |
| 7,219,385 | B1 * | 5/2007 | Rietsch, Jr. | 15/97.3 |
| 2001/0009049 | A1 | 7/2001 | Kasper et al. | |
| 2001/0022010 | A1 | 9/2001 | Kasper | |
| 2002/0026683 | A1 * | 3/2002 | Kasper et al. | 15/320 |
| 2002/0096258 | A1 | 7/2002 | Savas et al. | |
| 2003/0019071 | A1 | 1/2003 | Field et al. | |
| 2003/0029885 | A1 | 2/2003 | Kawolics et al. | |
| 2003/0135952 | A1 | 7/2003 | Coates et al. | |
| 2004/0040102 | A1 | 3/2004 | Field et al. | |
| 2004/0187895 | A1 | 9/2004 | Field et al. | |
| 2004/0221407 | A1 | 11/2004 | Field et al. | |
| 2005/0217062 | A1 | 10/2005 | Field | |
| 2006/0032519 | A1 | 2/2006 | Field | |
| 2006/0048331 | A1 | 3/2006 | Rau et al. | |

FOREIGN PATENT DOCUMENTS

| | | | |
|---|---|---|---|
| CN | 1138500 | C | 3/1995 |
| CN | 2221931 | Y | 3/1996 |
| CN | 1166778 | A | 12/1997 |
| DE | 44 13 783 | A1 | 3/1995 |
| EP | 0 744 148 | A2 | 11/1996 |
| EP | 0 826 333 | * | 3/1998 |
| EP | 1 044 645 | A2 | 10/2000 |
| GB | 2 303 570 | * | 2/1997 |
| JP | 11216092 | | 8/1999 |
| JP | 2002000529 | A | 1/2002 |
| JP | 2003135152 | A | 5/2003 |
| WO | 8400465 | | 2/1984 |
| WO | WO 95/09557 | | 4/1995 |
| WO | WO 00/35333 | | 6/2000 |
| WO | WO 02/05047 | | 1/2002 |
| WO | WO 02/06435 | | 1/2002 |

OTHER PUBLICATIONS http://www.stolzenberg.de/eng/technik, "The high point in the world of sweeper technology," Techik, 2 pages, May 4, 2005.

http://www.stolzenberg.de/eng/technik, "This revolution in the world of sweeping technology," Technik, 2 pages, May 4, 2005.

Discover Magazine, Jun. 2002, "Does the Universe Exist if We Don't Observe It?", including cover, Table of Contents, and pp. 26 and 27.

Office Communication for U.S. Appl. No. 11/211,987, filed Aug. 25, 2005. Date of Mailing: May 2, 2006.

Second Office Action corresponding to related Chinese Patent Application No. 200680007922.9 dated Mar. 1, 2010.

A First Office Action corresponding to related Japanese Patent Application No. 2008-500855 mailed Apr. 27, 2010.

International Search Report and Written Opinion of PCT/US2006/008159, mailed Jun. 27, 2006.

Alto Clarke Technology, Operator's Manual, Image 26E Wash & Rinse, Dec. 2000, 36 pages.

Vacuum sweeper and scrubber-drier Hakomatic B110, Superior Technology for Industrial Cleaning, HAKO, Jan. 4, 1994, 6 intro pages, pp. 1-137.

Office Communication from U.S. Appl. No. 11/211,987, mailed Aug. 18, 2006.

First Examination Report from corresponding European Patent Application No. 06737340.7 dated Dec. 13, 2010.

Third Office Action corresponding to Chinese Patent Application No. 200680007922.9 dated Dec. 1, 2010.

A Second Office Action from corresponding Japanese Patent Application No. 2008-500855, dated Mar. 8, 2011.

* cited by examiner

HARD AND SOFT FLOOR CLEANING TOOL AND MACHINE

CROSS-REFERENCE TO RELATED APPLICATIONS

This application claims the benefit of U.S. Provisional Application Ser. No. 60/660,820, filed Mar. 11, 2005; this application is a continuation-in-part of U.S. application Ser. No. 10/653,347 filed Sep. 2, 2003, now abandoned; and this application is a continuation-in-part of U.S. application Ser. No. 10/749,129 filed Dec. 30, 2003, now abandoned. All of the above-referenced applications are incorporated herein by reference in their entirety.

BACKGROUND OF THE INVENTION

Dry and wet floor cleaning operations are generally performed by dry carpet vacuum cleaners, wet carpet vacuum cleaners, hard floor sweepers and hard floor scrubbers. Dry carpet vacuum cleaners generally include a sweeping brush that rotates in a horizontal plane (i.e., parallel to the surface being cleaned) and a vacuum driven waste collection system. The rotating bristle brush beats and scrapes the carpet surface, and sweeps dust and debris into position for removal by the vacuum driven waste collection system.

Wet carpet vacuum cleaners generally include a scrubbing brush, a carpet cleaning liquid applicator, and a vacuum driven waste fluid recovery system. The carpet cleaning liquid applicator applies a very small amount of cleaning liquid or a dry cleaning liquid foam to the carpet surface. The scrubbing brush scrubs the cleaning liquid covered carpet and the vacuum driven waste collection system sucks the soiled cleaning liquid from the carpet and into a recovery tank. In order to prevent the vacuum driven waste recovery system from being clogged with large debris particles, the carpet is typically vacuumed with a dry carpet vacuum cleaner prior to performing the wet carpet cleaning operation.

Hard floor sweepers are similar to carpet cleaners in that they utilize a rotating sweeping brush to sweep dust and debris from the surface, which is then collected by a vacuum driven waste collection system. Such hard floor sweepers often include a dust control system that sprays the surface with water prior to engaging the surface with the sweeping brush to prevent sweeping the dust on the surface into the air.

Hard floor sweepers are generally not used on carpeted surfaces due to problems with static charge buildup, which can reset the electronics of the sweeper. Even when static straps, chains, and other components are used to "ground" the sweeper, problems with static charge buildup are encountered.

Hard floor scrubbers typically include a cleaning liquid applicator, one or more rotating scrubber brushes, and a vacuum driven waste collection system. The cleaning liquid applicator generally sprays cleaning liquid, or a foamed cleaning liquid, to the hard floor surface which is then scrubbed by the rotating scrubber brush. The scrubber brush, includes a horizontal scrubbing member (bristle brush or cleaning pad) that rotates about a vertical axis. The vacuum driven waste collection system generally includes a squeegee positioned at the rear end of the cleaner adjacent the scrubbing member that engages the floor and pools the liquid and debris. A vacuum sucks the pooled liquid and debris through a hose and deposits the collected waste into a recovery tank.

Prior to performing a hard floor scrubbing operation, it is generally necessary to first perform a sweeping operation on the floor. This is necessary to prevent the vacuum driven waste recovery system of the scrubber from being clogged with large debris particles. Combination hard floor cleaners have been developed that include both a hard floor sweeper and a hard floor scrubber, which eliminates the need for two separate machines. Such cleaners typically include two vacuum driven waste recovery systems: one for the collection of the dry or slightly damp debris collected by the sweeping system; and one for the soiled cleaning liquid produced by the scrubbing system.

Cleaning operations of multiple floor surfaces, such as those involved in both carpeted areas and hard floor surface areas (e.g., airports, offices, schools, etc.), require the use of multiple surface cleaners, such as, dry and wet carpet vacuum cleaners, and a hard floor sweeper and scrubber.

The use of such multiple machines to perform cleaning operations is time-consuming. First, the carpeted areas must be vacuumed with a dry carpet vacuum cleaner. Next, the carpeted areas must be cleaned with the wet carpet vacuum cleaner. Finally, the hard floor surface areas must be cleaned by either performing sweeping and scrubbing operations. using a hard floor surface sweeper and a hard floor surface scrubber, or with a combination hard floor surface cleaner.

Such multi-surface cleaning operations are costly due to the number of machines that are involved. Not only must each of the machines be properly maintained, but operators of the machines must be trained on each and enough storage space must be made available to store the machines.

Additionally, the vacuum systems of the dry and wet carpet cleaners and the hard floor sweepers and scrubbers consume a large percentage of the energy required to operate them. In addition to high energy costs, the operating runtime of battery powered systems, such as walk-behind hard floor scrubbers and sweepers, is significantly limited by their vacuum systems. As a result, larger batteries are required to provide the desired longer runtimes. Such batteries increase the cost of the machine due to the expense of the batteries themselves. Additionally, the machines become more expensive due to the necessity to make them larger in order to accommodate for the large batteries.

The significant noise generated by the vacuum systems of the dry and wet carpet cleaners and the hard floor sweepers and scrubbers is also problematic. For instance, it is common for businesses to have floor cleaning operations performed during non-business hours to avoid disturbing customers and employees by the machines. Even so, the need often arises to have a cleaning operation conducted during peak business hours resulting in a significant disturbance.

Embodiments of the present invention provide solutions to these and other problems, and offer other advantages over the prior art.

SUMMARY OF THE INVENTION

Embodiments of the present invention are generally directed to a cleaning tool and a mobile floor cleaner that includes the cleaning tool. Embodiments of the cleaning tool include a hub having a longitudinal axis and a plurality of cleaning members. The cleaning members, formed of a fibrous material, are connected to the hub. In accordance with one embodiment, the cleaning members are distributed along the longitudinal axis.

Embodiments of the floor cleaning machine include a mobile body configured to travel over a surface. The mobile body supports the cleaning tool, which is configured to scrub the surface. Additionally, the cleaning machine includes a motor configured to drive a rotation of the cleaning hub about the longitudinal axis.

DETAILED DESCRIPTION OF THE PREFERRED EMBODIMENTS

One aspect of the present invention is directed to a cleaning tool that is configured for use in a surface cleaner, such as hard and soft mobile floor cleaners. Another aspect of the present invention is directed to a mobile floor cleaner that includes the cleaning tool.

Figure 1:
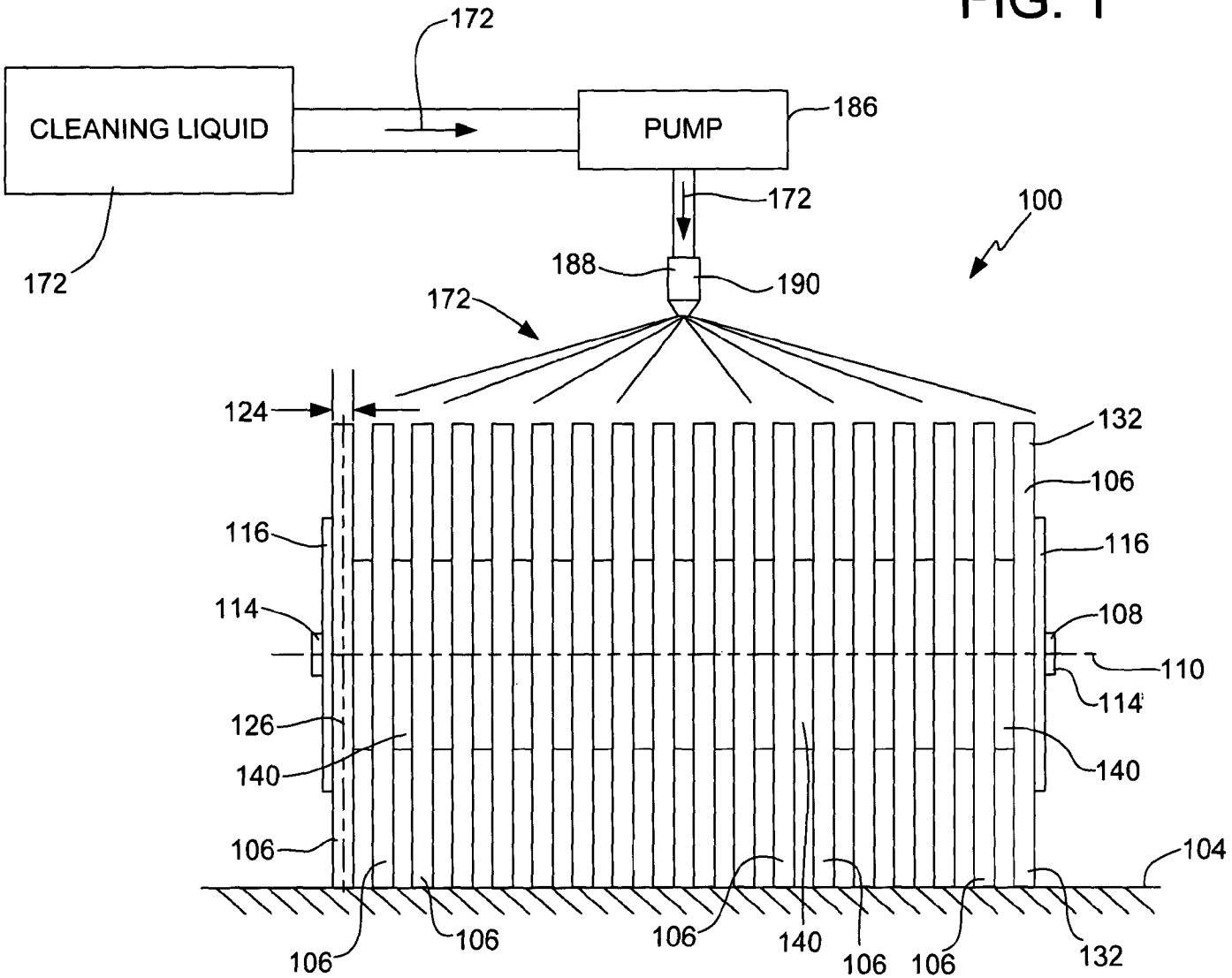
FIG. 1 is a front plan view of an exemplary cleaning tool in accordance with embodiments of the invention.
Figure 2:
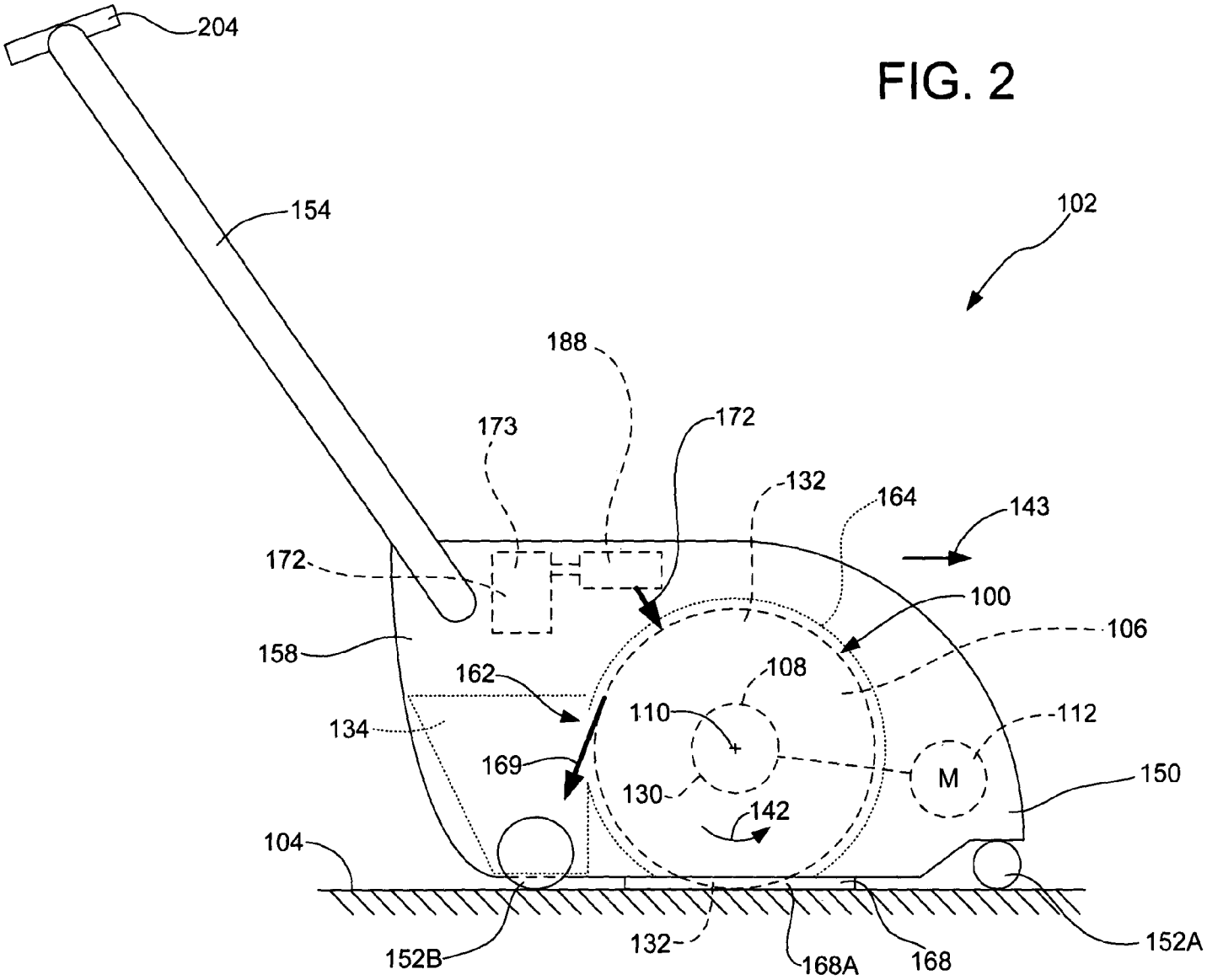
FIG. 2 is a simplified side view of an exemplary mobile floor cleaning machine in accordance with embodiments of the invention that includes the cleaning tool.

FIG. 1 is a front plan view of an exemplary cleaning tool 100 in accordance with embodiments of the invention. FIG. 2 is a simplified side view of an exemplary mobile floor cleaning machine 102 in accordance with embodiments of the invention that includes the cleaning tool 100. The machine 102 is configured to support the cleaning tool 100 for engagement with a surface 104 and to rotate the cleaning tool 100 to scrub the surface 104. Embodiments of the surface 104 can be a hard (e.g., cement, tile, stone, etc.) or soft floor surface (e.g., carpet, rug, etc.).

In one embodiment, the cleaning tool 100 comprises a plurality of cleaning members 106 connected to a hub 108. The hub 108 has an associated longitudinal axis 110, about which the cleaning. members are configured to rotate when installed in the cleaning machine 102. In one embodiment, the longitudinal axis 110 extends substantially parallel to the surface 104 when the cleaning tool 100 is installed in the machine 102, as illustrated in FIG. 1.

The hub 108 represents the structure to which the cleaning members are connected and which is rotated about the longitudinal axis 110 by a motor 112 of the cleaning machine 102. Thus, the hub 108 can take on many different forms including one or more components, which, taken as a whole, serve the purpose of supporting the cleaning members 106 for rotation about the longitudinal axis 110 when installed in the cleaning machine.

In one embodiment, the hub 108 is cylindrical and the longitudinal axis 110 is concentric with the cylindrical hub 108. Hub 108 can also take on alternative, non-cylindrical shapes, while still serving the cleaning member support function.

In one embodiment, the cleaning members 106 are distributed along the longitudinal axis 110, as shown in FIG. 1, for example. Embodiments of the cleaning tool 100 include distributing the cleaning members 106 along less than 48 inches of the hub 108, less than 36 inches of the hub 108, and less than 24 inches of the hub 108.

Figure 5B:
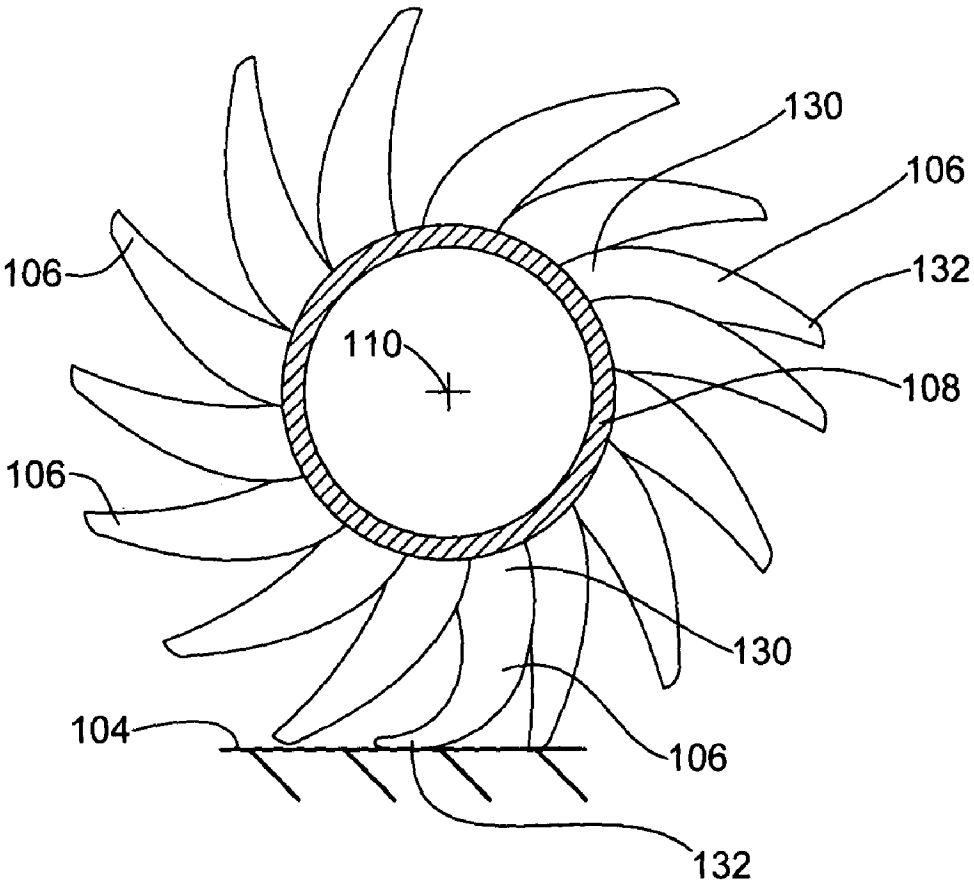
FIGS. 5A and 5B respectfully are front and side partial views of an exemplary cleaning tool in accordance with embodiments of the invention.

In accordance with other embodiments of the cleaning tool 100, the cleaning members 106 are distributed around the longitudinal axis 110. That is, the cleaning members 106 are angularly displaced from each other around the longitudinal axis 110, as shown in FIG. 5B.

With the hub 108 installed in the machine 102, the motor 112 is configured to rotate the hub 108 and the connected cleaning members 106 about the longitudinal axis 110. In one embodiment, the hub 108 includes ends 114 that are received by the machine 102. In one embodiment, the ends 114 are secured by a quick release mechanism to allow for convenient replacement of the tool 100. In another embodiment, the hub 108 comprises a sleeve that is configured to slide over a shaft of the machine 102 that is rotated by the motor 112. In yet another embodiment, the hub 108 comprises a shaft of the cleaning machine 102, to which the cleaning members 106 are connected.

The cleaning members 106 can be connected to the hub 108 either directly or indirectly (i.e., through an intermediary component). In one embodiment,. the connection of the cleaning members 106 to the hub 108 comprises compressing the cleaning members 106 between end members 116, such as rigid discs, that are secured to the hub 108, as shown in FIG. 1. Other means of securing the cleaning members 106 to the hub 108 or a component thereof include the use of glue, clamps, staples, screws, brackets, and other suitable mechanical means. In another embodiment, the cleaning members 106 extend through slots in the hub 108.

Figure 3A:
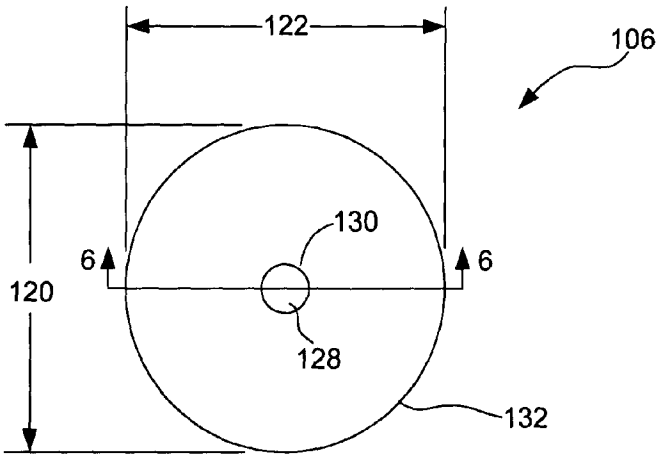
FIGS. 3A-3D are simplified plan views of exemplary cleaning members in accordance with embodiments of the invention.
Figure 3B:
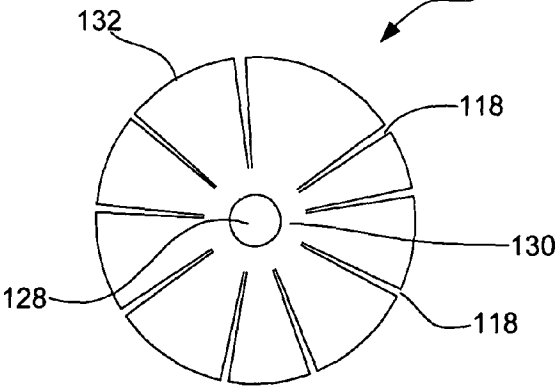
Figure 3C:
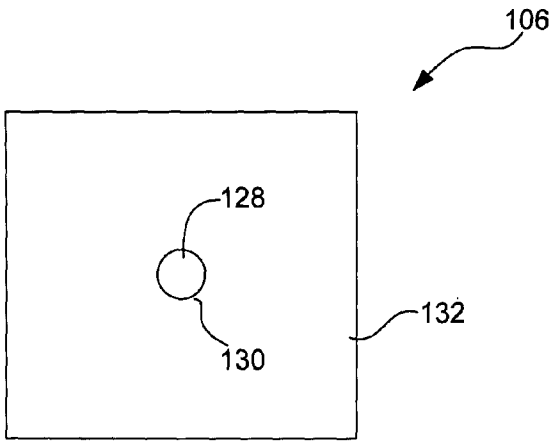
Figure 3D:
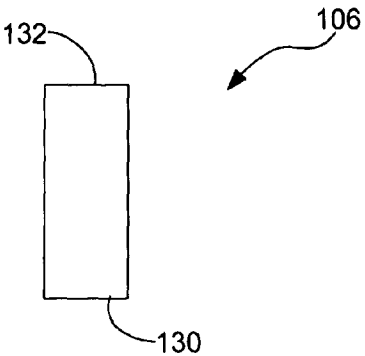

The cleaning members 106 can take on a variety of shapes. In accordance with one embodiment of the invention, the cleaning members 106 are disk-shaped, as shown in FIGS. 1, 2 and 3A. Additional embodiments including cleaning members having alternative shapes, examples of which are illustrated in FIGS. 3B-3D. In one embodiment, the cleaning members 106 include slits or notches 118, as illustrated in FIG. 3B. Other exemplary cleaning member shapes in accordance with embodiments of the invention include, oval, square (FIG. 3C), rectangular (FIG. 3D), triangular, irregular, symmetric, and other shapes.

In accordance with one embodiment, the cleaning members 106 are planar members having a width 120 and a length 122 (FIG. 3A) that are larger than a thickness 124 (FIG. 1). The widthwise and lengthwise edges, or the circular edge of the disk-shaped cleaning members, define the plane of the cleaning members 106 when lain or extended flat. In one embodiment, the thickness 124 is in a range of 0.002-0.25 inches while the width 120 and the length 122 are in the range of 2-24 inches.

Figure 4B:
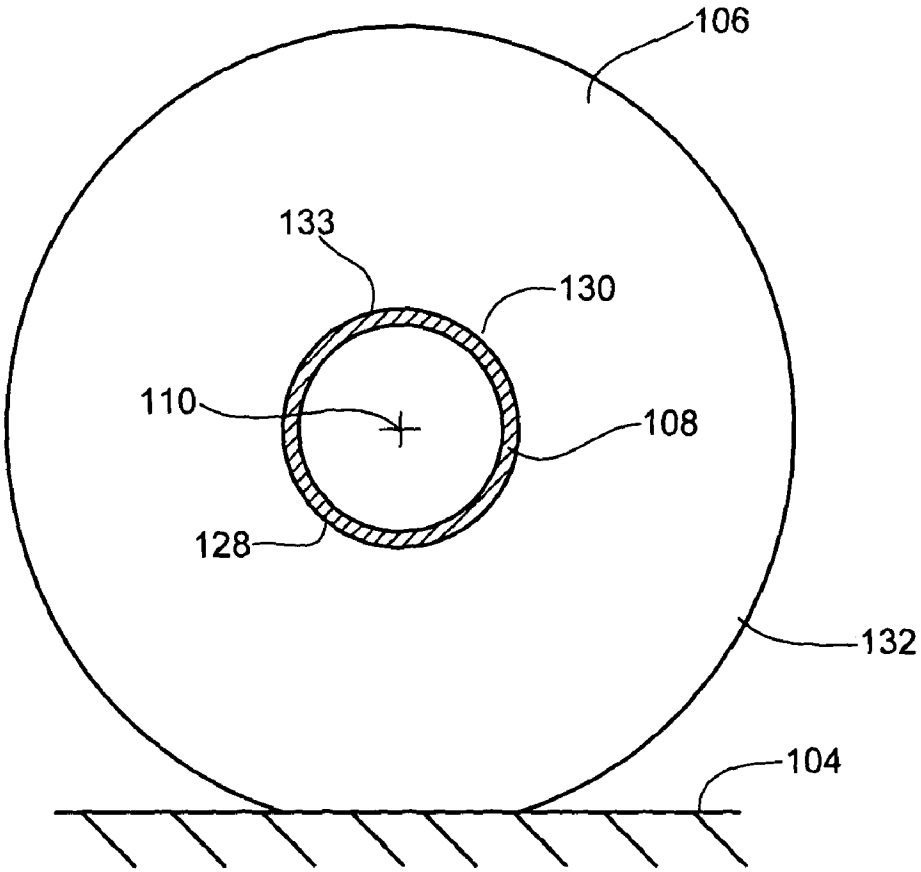
FIG. 4B is a side cross-sectional view of the exemplary cleaning tool of FIG. 4A.
Figure 4A:
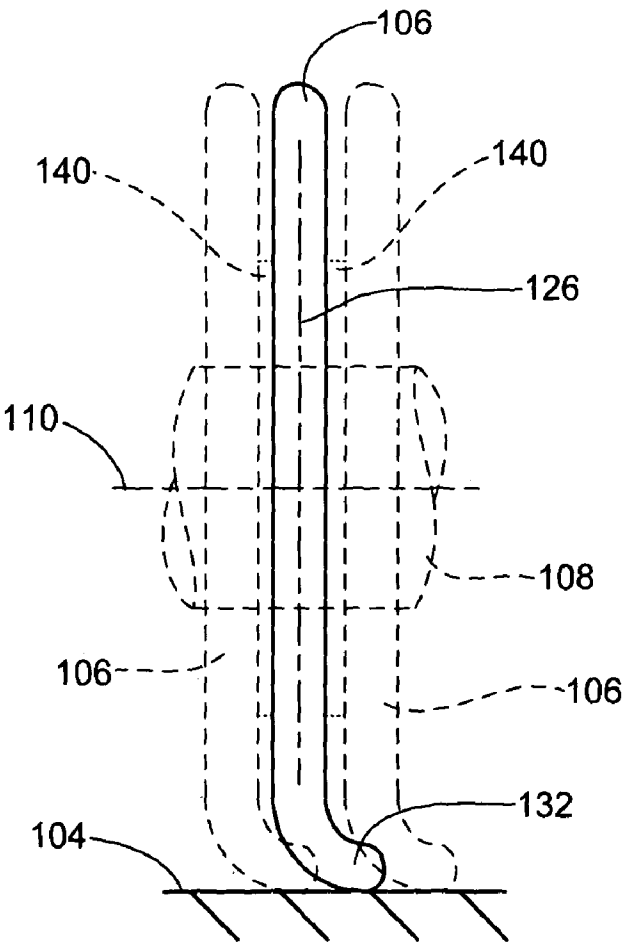
FIG. 4A is a front view of a portion of an exemplary cleaning tool illustrating an exemplary cleaning member in contact with the surface during rotation of the cleaning tool, with some components illustrated in phantom.

In one embodiment, the cleaning members 106 (i.e., the plane 126) are oriented transversely to the longitudinal axis 110, as shown in FIGS. 1, 4A and 4B. FIG. 4A is a front view of a portion of an exemplary cleaning tool 100 illustrating an exemplary cleaning member 106 in contact with the surface 104 during rotation of the cleaning tool 100. Additional cleaning members 106 and the hub 108 are shown in phantom. FIG. 4B is a side cross-sectional view of the exemplary cleaning tool of FIG. 4A. In another embodiment, the cleaning members 106 are approximately concentric with the longitudinal axis 110. In one embodiment, the hub 108 extends through an opening 128 (FIGS. 3A-3C) in the cleaning members 106, as shown in FIG. 4B.

Figure 5A:
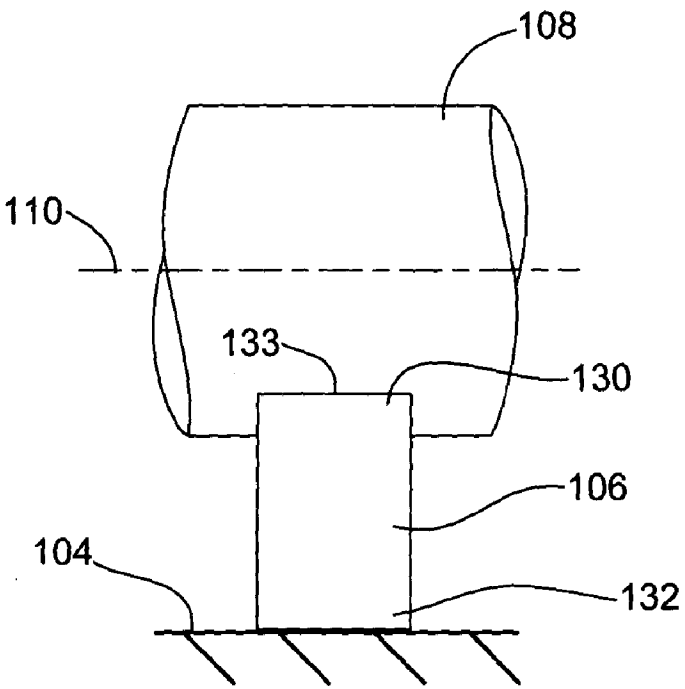

In yet another embodiment, the cleaning members 106 are oriented approximately parallel to the longitudinal axis, as illustrated in FIGS. 5A and 5B, which respectfully are front and side partial views of an exemplary cleaning tool 100 in accordance with embodiments of the invention. In FIG. 5A only one cleaning member 106 is depicted to simplify the illustration while several cleaning members 106 are shown in FIG. 5B.

In another embodiment, the cleaning members include a proximal end 130 that is connected either directly or indirectly to the hub 108 and a distal end 132 that is displaced from the proximal end in a radial direction from the longitudinal axis 110 when the cleaning members 106 are extended or rotated about the longitudinal axis 110. When the hub 108 extends through the openings 128 of the cleaning members 106 (FIGS. 4A and 4B), the proximal end 130 is the edge of the opening 128.

In one embodiment, the proximal end 130 includes an elongate edge 133 that is oriented transversely to the longitudinal axis 110, as shown in FIG. 4B. In another embodiment, the elongate edge 133 of the proximal end 130 is oriented approximately parallel to the longitudinal axis 110, as shown in FIG. 5A.

In accordance with one embodiment, at least the surface engaging portions (e.g., the distal ends 132 or outer edge portions) of the cleaning members 106 include a fibrous material. The phrase "fibrous material", as used herein, is intended to describe a material that comprises a plurality of entwined fibers or a weave of a single fiber. Accordingly, the bristles of conventional sweeper scrub heads are not formed of a fibrous material, because they do not comprise such entwined or woven fibers.

The fibrous material of the cleaning members 106 facilitates the collecting, capturing or grabbing solid and liquid waste from the surface 104 during a cleaning operation, which can then be discharged into a waste container 134 of the machine 102. In one embodiment, the fibrous material also allows the cleaning members 106 to flex at the distal ends 132 when brought into contact with the surface 104 under relatively low pressures, as illustrated in FIGS. 4A and 5B. This allows the cleaning members 106 to expand the scrubbing surface of the cleaning members. 106 beyond the tip of the distal end 132. Additionally, the flexibility of the distal end 132 of the cleaning members 106 allows the cleaning members to conform to the surface 104 being scrubbed. As explained below in greater detail, such waste collection properties of the cleaning members 106 eliminate the need for a vacuum driven waste recovery device, such as that used by hard and soft floor cleaning machines of the prior art.

One exemplary fibrous material that can be used in the cleaning members to provide the desired solid and liquid waste collection function is microfiber, such as that produced by Toray Ultrasuede (America), Inc., of New York, N.Y. In accordance with another embodiment, the fibrous material comprises polyester and polyamide, such as approximately 70% polyester and 30% polyamide. In accordance with another embodiment, the fibrous material includes spandex (e.g., 3%) to provide elasticity to the cleaning members 106 which can provide additional flexibility to the cleaning members 106 to allow them to conform to the surface they are scrubbing. Other embodiments of the fibrous material include Kevlar and/or nylon. Such materials can be used to increase the durability of the cleaning members 106.

Each cleaning member 106 can comprise one or more layers of the fibrous material. In accordance with one embodiment of the invention, the cleaning members 106 are formed of a single layer of the fibrous material having a desired thickness 124. Multiple layer cleaning members 106 can also be formed that include two or more pieces of the fibrous material that are connected to each other, preferably at their edges.

Figure 6:
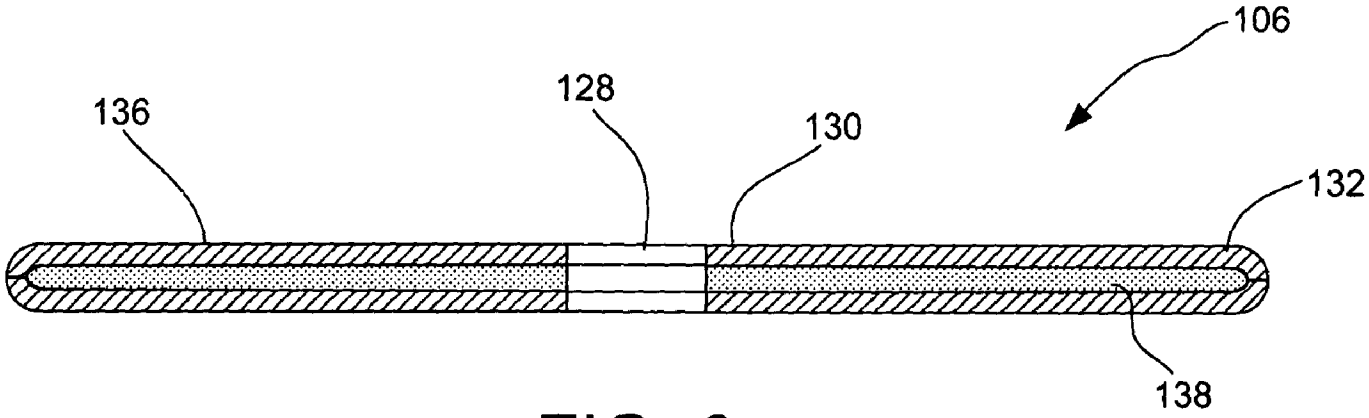
FIG. 6 is a side cross-sectional view of a cleaning member taken generally along line 6-6 of the cleaning member depicted in FIG. 3A, in accordance with embodiments of the invention.

In one embodiment, the cleaning members 106 include a first layer 136 formed of the fibrous material and a second layer 138 formed of another material that is different from the fibrous material, as illustrated in FIG. 6, which is a side cross-sectional view taken generally along line 6-6 of an embodiment of the cleaning member 106 depicted in FIG. 3A.

In accordance with one embodiment, the second layer 138 is configured to provide a desired rigidity to the cleaning member 106. For example, it may be desirable to have a more rigid cleaning member 106 for use in cleaning operations for more resilient surfaces, such as concrete or stone, and a less rigid cleaning member 102 for more delicate surfaces, such as hard wood floors, or to provide a desired scrubbing action on the surface. Exemplary materials forming the second layer 138 include foam, rubber, plastic, and other materials.

In one embodiment, the second layer 138 is substantially enclosed by the first layer 136, as illustrated in FIG. 6. Thus, the second layer 138 can define a desired thickness to the cleaning member 106, including a varied thickness in the cleaning member 106. For example, the portion of the cleaning member 106 adjacent the proximal end or edge 130 can be made thicker than the portion adjacent the distal end 132, which can then cause a gap between the distal ends 132 of adjacent cleaning members 106 when arranged in a side-by-side fashion.

In accordance with another embodiment of the invention, the cleaning tool 100 includes a plurality of spacer members 140 between adjacent cleaning members 106, as shown in FIGS. 1 and 4A (phantom).

Figure 7:
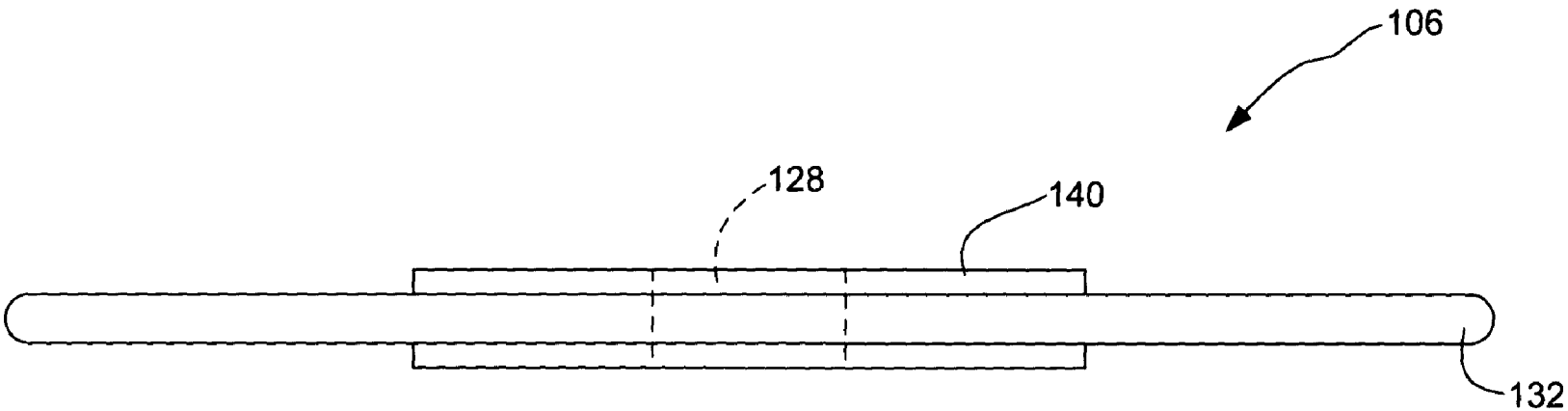
FIG. 7 is a side view of an exemplary cleaning member in accordance with embodiments of the invention.

The spacer members 140 provide additional space between the distal ends 132 of adjacent cleaning members 106, which allows the cleaning members 106 to flatten against the surface 104 (FIG. 4A) and improve cleaning performance. In one embodiment, the spacer members 140 are not formed of a liquid absorbing material, such as foam, plastic, rubber, or other suitable material. In accordance with one embodiment of the invention, the spacer members 140 are each attached to one or both sides of the cleaning members 106, as shown in FIG. 7, which is a side view of an exemplary cleaning member 106.

Figure 8:
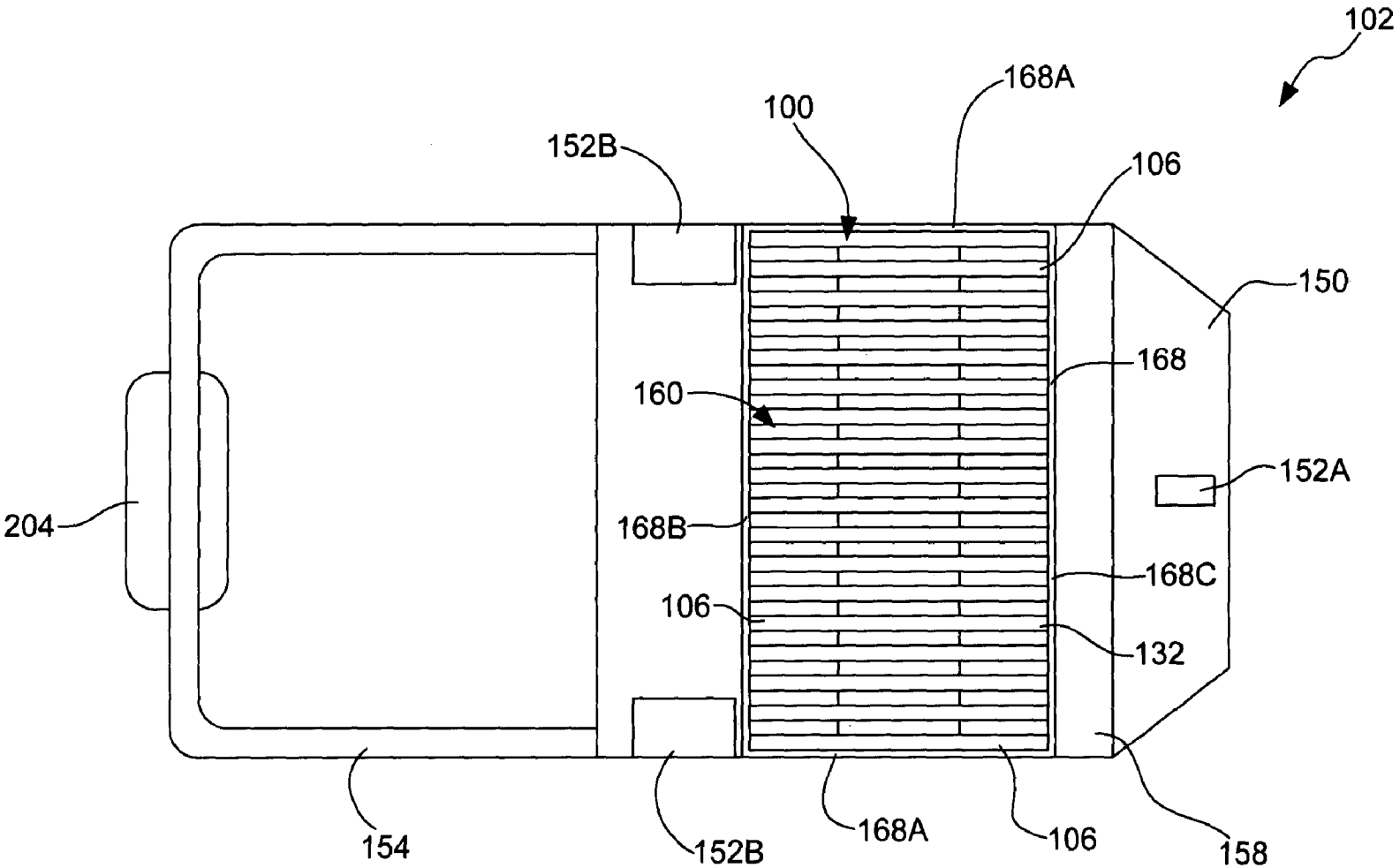
FIG. 8 is a bottom view of the exemplary floor cleaning machine shown in FIG. 2.
Figure 9:
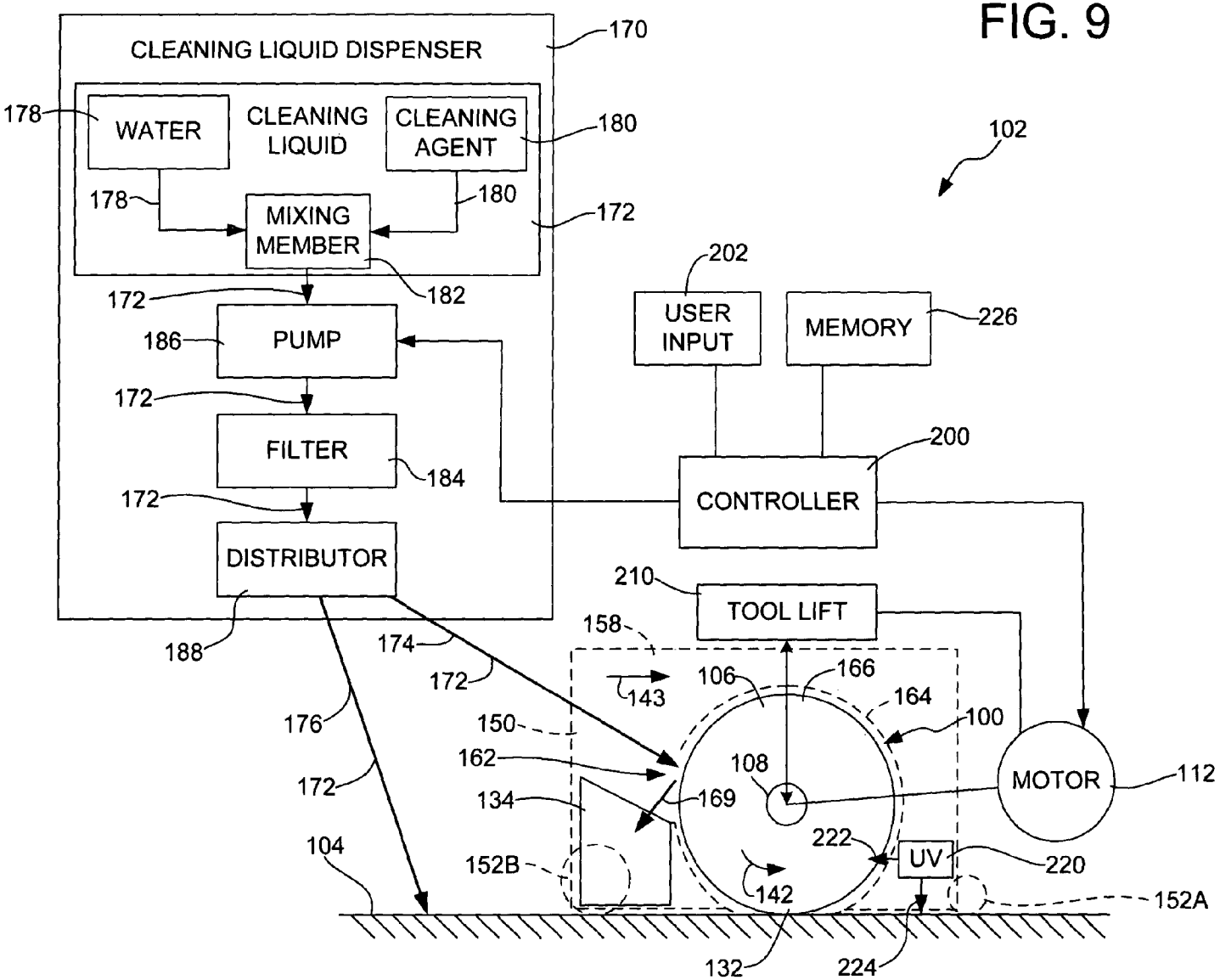
FIG. 9 is a simplified diagram of a floor cleaning machine in accordance with various embodiments of the invention.

A more detailed discussion of embodiments of the floor cleaning machine 102 will be provided with reference to FIGS. 2, 8 and 9. FIG. 8 is a bottom view of the exemplary floor cleaning machine 102 shown in FIG. 2. FIG. 9 is a simplified diagram of a floor cleaning machine 102 in accordance with various embodiments of the invention.

The floor cleaning machine 102 generally includes a mobile body 150, the cleaning tool 100 described above, and the motor 112. The cleaning tool 100 and the motor 112 are both supported on the mobile body.

In one embodiment, the motor 112 is an electric motor powered by batteries supported on the mobile body (not shown) or line power through an appropriate cable. Alternatively, the motor 112 can be a combustible engine.

The motor 112 is generally configured to rotate the cleaning tool 100 about the longitudinal axis 110 during cleaning operations of the surface 104. In one preferred embodiment, the motor 112 rotates the cleaning tool as indicated by arrow 142 shown in FIGS. 2 and 9. In accordance with this embodiment, the distal ends 132 of the cleaning members 106 that are engaging the surface 104 move in a forward direction indicated by arrow 143. In another embodiment, the motor 112 rotates the cleaning tool 100 in the direction that is opposite that indicated by arrow 142.

The linear velocity (hereinafter "tip speed"), at which the surface engaging distal ends 132 of the cleaning members 106 are traveling depends on the angular velocity at which they are rotating about the horizontal axis and the distance the distal ends 132 extend radially from the longitudinal axis 110. In accordance with one embodiment, an angular velocity of approximately 200-500 revolutions per minute (rpm) is used for a cleaning tool 100 that includes disk shaped cleaning members 106 having a diameter of approximately 8 inches. It should be noted that this is a significant reduction in the angular velocity at which conventional sweepers and scrubbers rotate their tools, which is approximately 600-800 rpm. Not only does the reduced velocity at which the cleaning tool 100 of the present invention rotates result in a significant energy savings, but it also reduces the operating noise level of the surface cleaner 102.

Embodiments of the mobile body 150 include a frame or housing to which wheels, generally designated as 152, or other mobile support is attached, which allows for the mobile body 150 to travel over the surface 104. While the floor cleaning machine 102 is depicted as a walk-behind machine, embodiments of the machine also include a ride-on mobile body.

In one embodiment, one or more front wheels 152A pivot to allow for easy direction control of the machine 102. In another embodiment, one or more of the wheels 152, such as rear wheels 152B, are driven by a motor, such as motor 112, or a separate motor (not shown).

In accordance with another embodiment, none of the wheels 152 are motor driven. Instead, the mobile body is propelled manually by the operator. In one embodiment, the machine 102 includes a handle 154 that extends in a rearward direction from the mobile body that is opposite the forward direction 143. The operator pushes on the handle 154 to propel the machine 102 in the forward direction 143 over the surface 104, and pulls on the handle to move the machine 102 over the surface 104 in the rearward direction.

In one embodiment, the machine 102 includes a housing 158, which can be part of the mobile body 150. The housing 158 generally encloses components of the machine 102 and provides other functions. One embodiment of the housing 158 includes a bottom opening 160 (FIG. 8) through which the distal ends 132 of the cleaning tool 100 can extend toward the surface 104, as shown in FIG. 2.

One embodiment of the housing includes an opening 162 that exposes the waste container 134 to the cleaning tool 100. Liquid and solid waste collected by the cleaning members 106 during rotation of the cleaning tool 100 is discharged through the opening 162 and into the waste container 134.

Another embodiment of the housing 158 includes a surround portion 164 that substantially conforms to the exterior surface (e.g., distal ends 132 of the cleaning members 106) of at least a portion of a top side 166 of the cleaning tool 100 during operation, as shown in FIGS. 2 and 9. The surround portion 164 functions to guide the waste collected by the cleaning tool 100 over the cleaning tool 100 and to the opening 162 where it is discharged into the waste container 134 when the cleaning tool is rotated in the direction indicated by arrow 142. In accordance with embodiments of the invention, a gap between the surround portion 164 and the top side 166 of the cleaning members 106 is less than 0.3 inches, and preferably 0.2 inches or less.

Other embodiments of the housing 158 include a removable cover (not shown) through which the components of the machine 102 can be accessed.

Skirting 168 (FIGS. 2 and 8) preferably extends downward from the perimeter of the bottom opening 160 to the surface 104 to prevent spray from the rotating cleaning tool 100 from escaping from under the cleaner 102. Embodiments of the skirting 168 include, flexible shield members 168A positioned at the sides of the opening 160, a flexible shield member 168B positioned at a rear side of the opening 160, and/or a flexible shield member 168C positioned at a front side of the opening 160. In one embodiment, the skirting 168 includes at least shield members 168A.

The waste container 134 is supported on the mobile body 150 and can form a portion of the housing 158. As discussed above, the waste container 134 is positioned to receive waste (e.g., liquid and solid waste), represented by arrow 169, that is flung from the rotating cleaning members 106 through the opening 162. In one embodiment, the waste container 134 is located at the rear side of the machine 102 and the opening 162, as shown in FIGS. 2 and 9.

In another embodiment, the waste container 134 is located on the front side of the cleaning tool 100, which is opposite the location of the container 134 shown in FIGS. 2 and 9. In one embodiment, the cleaning tool 100 is rotated in the opposite direction of that indicated by arrow 142.

In accordance with one embodiment of the invention, the waste container 134 is removable from the cleaner 102 for easy disposal of the waste contained therein. In accordance with another embodiment of the invention, the waste container 134 includes a disposable container or liner, in which the waste 169 from the cleaning tool 100 is collected. The disposable container can be discarded when full. This embodiment of the invention reduces contact between the user of the cleaner 102 and the collected waste.

One embodiment of the floor cleaning machine 102 includes a cleaning liquid dispenser 170 supported on the mobile body 150. One embodiment of the dispenser 170 includes a supply of cleaning liquid 172, as shown in FIG. 9. In one embodiment, the supply of cleaning liquid 172 is held in a container 173 (FIG. 2) that is supported on the mobile body 150. Embodiments of the container 173 include a fixed tank and a removable container.

The dispenser 170 is generally configured to apply the cleaning liquid 172 to the cleaning members 106 of the cleaning tool 100, as indicated by arrow 174 in FIGS. 2 and 9. In another embodiment, the cleaning liquid dispenser 170 is configured to apply the cleaning liquid from the supply 172 to the surface 104, as indicated by arrow 176, but preferably to the front side of the cleaning tool 100 rather than the rear side as shown in FIG. 9. In yet another embodiment, the cleaning liquid dispenser 170 applies cleaning liquid to both the surface 104 and the cleaning members 106.

One embodiment of the supply of cleaning liquid 172 solely comprises water 178 (e.g., tap water, distilled water, deionized water, deionized highly filtered (i.e., soft). water supply, etc.). It is understood by those skilled in the art that such a cleaning liquid would contain additional elements that are normally found in water supplies.

Another embodiment of the supply of cleaning. liquid 172 comprises a mix of water (e.g., tap water, distilled water, deionized water, etc.) and a cleaning agent (e.g. detergent or other chemical additive). In one embodiment, the water and cleaning agent are premixed and stored in the container 173 as the cleaning liquid. In accordance with another embodiment, the dispenser 170 includes separate supplies of water 178 and cleaning agent 180 supported on the mobile body 150, which are combined by a mixing member 182 to form the cleaning liquid 172, as shown in FIG. 9. In one embodiment, the supply of cleaning agent 180 is contained in a removable container supported on the mobile body 150.

Embodiments of the mixing member 182 include a fluid flow junction, such as a t-coupling joining the tubing from the water supply 178 to the tubing from the cleaning agent supply 180, valves, and/or other flow regulating components. In one embodiment, the mixing member 182 includes an injector that injects the flow of cleaning agent 180 into the flow of water 178 at a predetermined rate that achieves the desired mixing ratio. In one embodiment, the injector operates to siphon the cleaning agent 180 using a venturi member. In operation, the flow of the water 178 through the injector creates a vacuum that draws the flow of cleaning agent 180 into the flow of water 178 at the desired rate. One such suitable injector is the 50580 siphon produced by Spraying Systems Company of Wheaton, Ill.

In accordance with one embodiment of the invention, the cleaning agent supply 180 is in a concentrated form (e.g., more than 30% solids). One embodiment of the cleaning agent 180 includes a polymer-based surfactant that cleans, disinfects, and removes or dissolves scum, mold, mildew, stains and odors. Additionally, the surfactant is preferably safe for application to carpet, natural fibers, fixtures, tiles, chrome, fiberglass, baked enamel, porcelain, vinyl, stainless steel, synthetic marble and other materials.

In addition to including one or more surfactants, the cleaning agent 180 may include builders, solvents, or other components. In accordance with one embodiment of the invention, the cleaning agent includes an anionic surfactant, a non-anionic surfactant, a cationic surfactant, or a combination thereof. A particularly preferred surfactant is DETERIC CP-Na-38 manufactured by DeForest Enterprises, Inc. of Boca Raton, Fla.

Additional embodiments of the cleaning liquid 172 include one or more additives such as, for example, an anti-fungal additive and/or an anti-bacterial additive.

Typical cleaning liquids utilize non-filtered tap water containing hard minerals such as iron and manganese (i.e., hard water). Unless wiped clean, the surfaces can take a long time to dry. Additionally, spots or residue often form on non-wiped surfaces as a result of the hard minerals in the water. In accordance with one embodiment of the invention, the water used to form the cleaning liquid 172 consists of a de-ionized highly filtered (i.e., soft) water, which reduces the likelihood of a residue forming on the surface following a cleaning operation.

In accordance with another embodiment of the invention, the cleaning liquid dispenser 170 includes a filter 184 that is in line with the flow of cleaning liquid 172. The filter 184 operates to remove hard minerals (e.g., iron and manganese) from the water of the cleaning liquid 172 prior to its application to the cleaning tool 100 or the surface 104. In one embodiment, when separate water 178 and cleaning agent 180 supplies are utilized, the filter 184 can be inline with the water supply 178, but prior to the mixing member 182. Embodiments of the filter 184 include filtering elements such as ceramic, glass fiber, hard-block carbon, and/or other water-filtering materials. One preferred water filter is the General Electric "SmartWater" model C, filter system, which reduces chlorine sediment, minerals and rust, all of which add to residue.

When the cleaning liquid 172 comprises water and a cleaning agent, the ratio of water to cleaning agent/additive in the cleaning liquid 172 is preferably very high, such as 1000:1. In accordance with a preferred embodiment of the invention, the ratio of water to cleaning agent is approximately 3000:1. Such a high ratio of water to cleaning agent provides effective cleaning of the surface 104 while reducing the likelihood of leaving a visible residue behind. Additionally, the low percentage of cleaning agent in the cleaning liquid results in very little chemical waste from cleaning operations. As a result, embodiments of the present invention leave very little cleaning agent residue following application to the surface 104, produces very little chemical waste, and increases the life of the supply of cleaning agent 180.

One embodiment of the cleaning liquid dispenser 170 includes a pump 186 and a cleaning liquid distributor 188. The pump 186 is configured to drive a flow of the cleaning liquid from the supply 172 to the distributor 188. Embodiments of the invention include the driving of the cleaning liquid at flow rates of less than 100 cubic centimeters per minute (cc/min.), 50 cc/min., 20 cc/min. and 10 cc/min. One suitable pump 186 is the SLV10-AC41 manufactured by ShurFlo.

In accordance with one embodiment of the invention, the pump 186 is pulsed to provide the desired flow rate of cleaning liquid to the distributor. For example, the pump 186 can be enabled for a period of 0.5 seconds for each 13 second cycle. Such pulsing of the pump 186 provides a flow rate of cleaning liquid to the cleaning members 106 of approximately 20 cubic centimeters per minute. Other cleaning/rinsing cycles can also be performed using different pulsing periods, as will be discussed below.

The distributor 188 discharges the cleaning liquid 172 to the desired location (i.e., the cleaning members 106 and/or the surface 104). In accordance with one embodiment, the distributor 188 includes at least one nozzle 190, as shown in FIG. 1, which directs the flow of cleaning liquid to the cleaning members 106 (as shown) or to the surface 104. In one embodiment, the distributor 188 includes a single wide angle spraying nozzle 190 to spray the cleaning liquid 172 across the surface of the cleaning members 106, as shown in FIG. 1. One such suitable nozzle is the R187C manufactured by Rain Drip, Inc.

In accordance with another embodiment of the invention, the machine 102 includes an aerator configured to aerate the cleaning liquid into a foam. The aerator can be combined with the cleaning liquid distributor 188 in the form of an aerating nozzle.

A controller 200 (FIG. 9) controls the operations of the machine 102 including the operations of the motor 112 and the pump 186. A user input 202 can be provided to the controller 200 to trigger various cleaning operations or cycles, which will be discussed below. The user input 202 can be accessed through a control panel 204 mounted to the handle 154, for example.

One embodiment of the machine 102 lacks a vacuumized waste recovery system, such as a vacuumized squeegee, for example. Instead, the machine 102 relies upon the liquid and solid waste collection properties of the fibrous cleaning members 106 to pick up solids and liquids on the surface 104, as well as scrub the surface 104, particularly when wetted by the cleaning liquid, and discharge the collected waste 170 into the waste container 134 in response to the centrifugal forces generated by the rotation of the cleaning members 106.

The lack of a vacuumized waste recovery system results in quieter cleaning operations and a machine 102 that is relatively highly energy efficient. As a result, the machine 102 of the present invention is more appropriate for use during business hours than the prior art cleaners that have vacuumized waste recovery systems. Additionally, the machine 102 of the present invention can be formed smaller, lighter, and have longer run times (i.e., when battery powered) than cleaners of the prior art.

One embodiment of the machine 102 includes a vacuumized waste recovery system supported on the mobile body 150. Embodiments of the vacuumized waste recovery system are configured to remove collected debris from the surface 104, the waste container 134, and/or a remote location from the machine 102 (e.g. through a vacuum hose).

The wetting of the fibrous material used in the cleaning members 106 (e.g., microfiber), allows the cleaning members 106 to dissipate static charge thereby eliminating the need for static discharging elements, such as chains. As a result, the machine 102 avoids static discharge problems that can damage conventional surface cleaners and makes the machine 102 suitable for both hard and soft floor cleaning operations.

As a result, the cleaning tool 100 is capable of performing both carpet and hard floor surface cleaning operations without having to adjust the machine 102. Thus, a single machine 102 operated by a single person is capable of performing a carpet cleaning operation at one instant and move directly to a hard floor cleaning operation at another instant without stopping to adjust the machine 102. This. provides a significant advantage over prior art cleaning methods that involve the use of different machines for hard and soft floor cleaning operations.

The use of low cleaning liquid flow rates also makes for quick drying of hard and soft floor surfaces 104.

One embodiment of the invention includes a method of cleaning hard and soft floor surfaces using the machine 102 without reconfiguring the machine 102. In the method, the machine 102 is moved over a hard floor surface while rotating the cleaning tool 100 and engaging the hard floor surface with the cleaning members 106 and then moved over a soft floor surface while maintaining the rotation of the cleaning tool 100 and engaging the soft floor surface with the cleaning members 106. Additional embodiments include applying the cleaning liquid to the cleaning members, rotating the cleaning members 106 such that they are moving in the forward direction (arrow 143) at the surface, and collecting waste 170 picked up by the cleaning members 106 in a waste container 134.

In accordance with another embodiment of the invention, the machine 102 includes a motorized cleaning tool lift 210, illustrated schematically in FIG. 9, that is supported by the mobile body 150. The cleaning tool lift 210 is configured to raise and lower the cleaning tool 100 relative to the housing 202 and the surface 104 being cleaned. In accordance with a preferred embodiment of the invention, the cleaning tool lift 210 automatically adjusts the position of the cleaning tool 100 such that the cleaning tool 100 applies a substantially constant downward force to the surface 104. The downward force can be adjustable through the user input 202, such as through the control panel 204. Thus, the cleaning tool 100 may be lowered, for example, when the machine 102 transitions from a carpeted surface to a hard floor surface while applying substantially the same downward force to both surfaces. Suitable cleaning tool lifts are described in U.S. Pat. Nos. 4,675,935, 4,679,271 and 4,757,566.

Although the centrifugal force generated by the rotation of the cleaning tool 100 operates to discharge most of the liquid and debris collected by the cleaning members 106 into the waste container 206, the cleaning members 106 may remain slightly damp following cleaning operations. Accordingly, bacteria and mold may develop on the cleaning tool if a long period of time elapses since the last cleaning operation. This problem may be alleviated by performing drying cycles and the inclusion of anti-fungal and/or anti-bacterial components in the cleaning liquid.

In accordance with one embodiment of the invention, the machine 102 includes a UV sanitizer 220 (FIG. 9) having a source of radiation that is operated under the control of the controller 200 (e.g., Direct Logic model number DO-05DR-D). The UV sanitizer 220 is configured to control bacterial and fungal growth on the cleaning tool 100, as indicated by arrow 222. The source of radiation is preferably contained within the housing 158 such that it is sufficiently shrouded to prevent significant UV radiation leakage and eliminate the need for eye protection by the operator. The source of UV radiation is preferably configured to apply a substantially uniform dosage of UV radiation to the surface of the cleaning members 106 across the width of the cleaning tool 100 of a sufficient magnitude to provide a degree of sanitization to the surface of the cleaning members 106. Preferably, the dosage of radiation applied to the surface of the cleaning members 106 is in a range of 10-60 mW $cm^2$.

The source of UV radiation may include one or more UV lamps or other suitable UV source. The UV lamps are preferably mercury flood lamps having a ballast incorporated on the lamp (self-ballasted). Alternatively the UV lamps may be externally ballast driven. An optional cooling apparatus, such as a fan, may be provided to insure sufficient cooling of the UV source. In accordance with one embodiment, the wavelength of the UV radiation produced by the UV source is in the UV-C range, which is less than 280 nanometers. In accordance with one embodiment of the invention, the primary energy of the UV source is at a wavelength that is within a range of 240-260 nanometers. One suitable UV source is produce number: 90-0012-01 manufactured by UVP-Inc. of Upland, Calif., which emits a mercury spectrum with the primary energy at a wavelength of 254 nanometers.

In accordance with another embodiment of the invention, the source of UV radiation of the UV sanitizer 220, or another UV source, applies UV radiation (arrow 224) to the surface 104 to kill bacteria and other germs thereon. Embodiments of the UV radiation applied to the surface 104 include the dosages described above.

Embodiments of the machine 102 can perform several different cleaning operations or cycles. The cycles can be performed automatically by the controller 200 or in response to the user input 202. Examples of such cleaning cycles will be discussed below.

A start-up or pre-wetting cycle for the machine 102 is can be performed prior to the cleaning operation to ensure that the cleaning tool 100 is sufficiently wet with cleaning liquid. In accordance with one embodiment of the invention, a predetermined volume of the cleaning liquid is applied to the cleaning members 106 by the cleaning liquid dispenser 170 while the cleaning tool 100 is rotated by the motor 112. The centrifugal force on the applied cleaning liquid generated by the rotation of the cleaning tool 100, limits the amount of cleaning-liquid that remains on the cleaning members 106 at the completion of this pre-wetting cycle . . .

In accordance with one embodiment of the invention, the pre-wetting cycle is performed only when an assessment of the liquid content of the cleaning tool 100 indicates that it is necessary to do so. In accordance with one embodiment of the invention, historical operation information is maintained in onboard memory 226 of the machine 102 that includes information that can be used to assess the wetness of the cleaning tool 100. For example, information regarding the last time the machine 102 was operated, the time and amount of cleaning liquid that was last applied to the cleaning tool 100, the time when the last pre-wetting cycle was conducted, etc. can be stored in the memory 226, from which a determination of whether a pre-wetting cycle should be performed can be made.

In accordance with another embodiment of the invention, a sensor is used to assess a wetness of the cleaning tool 100 and the pre-wetting cycle is performed when the sensor indicates that the wetness is below a threshold value.

Surface cleaning operations are generally performed by applying the desired dosage of cleaning liquid to the cleaning members 106 of the cleaning tool 100 as the cleaning tool 100 is rotated by the motor 112. The cleaning members 106 pick up solid-and liquid waste from the surface 104 (e.g., tile, stone, cement, carpet, wood, etc.) while simultaneously scrubbing the surface 104 with the cleaning liquid dampened cleaning members 106. The cleaning members 106 flex and conform to the surface 104 in response to the cleaning tool 100, as shown in FIGS. 4A and 5B. Thus, the distal ends 132 of the cleaning members 106 that engage the surface 104 preferably flatten slightly to provide the desired scrubbing of the surface 104 while reducing the likelihood of forming "stripes" of residue in the wake of the machine 102 on hard surfaces. Additionally, when the cleaning members 106 are vertically oriented, they can enter crevices and remove debris and liquid contained therein.

During surface cleaning operations, the cleaning tool 100 is continuously cleaned due to the flinging of the waste 170 (liquid and particulate) into the waste container 134 and through the application of fresh cleaning liquid 172 to the cleaning members 106. A tool cleaning operation can be performed by wetting the cleaning tool 100 and rotating it without operating the machine 102 over a dirty surface 104. Multiple tool cleaning operations can be performed to remove excess debris from the cleaning members 106.

Occasionally, it may be desired to apply a burst of cleaning liquid to the cleaning tool 100 or the surface 104 in order to clean a stain or a dried mess on the surface 104, for example. In accordance with one embodiment of the invention, the operator of the machine 102 can apply a user input 202 (e.g., a press of a button) to the controller 200, which briefly increases the amount of cleaning liquid 172 that is discharged by the cleaning liquid dispenser 170.

Additional user inputs 202 can adjust the rotational velocity of the cleaning tool 100 and/or the pressure that is applied to the surface 104 by the cleaning tool 100, in order to provide the desired scrubbing action of the surface 104.

The machine 102 may also perform a rinse cycle to remove debris and cleaning liquid from the cleaning tool 100. In general, water is applied to the cleaning tool 100 as it rotates, which rinses the tool. In accordance with one embodiment of the invention where the cleaning liquid 172 is formed by mixing separate supplies of water 178 and a cleaning agent 180 (FIG. 9), water from the onboard water supply 178 can be directed to the cleaning tool 100 through the cleaning liquid dispenser 170, or other device.

A drying cycle can also be performed by the machine 102 by rotating the cleaning tool 100 at a high angular velocity without applying the cleaning liquid thereto. The high rotational velocity of the cleaning tool 100 causes the liquid absorbed by the cleaning members 106 to be released into the waste container 134.

The machine 102 can also be used to apply coatings to surfaces, such as wax coatings. In accordance with this embodiment of the invention, the cleaning liquid 172 is replaced with a liquid wax that is applied to the cleaning tool 100 or the surface 104, and is worked into the surface 104 by the rotation of the cleaning members 106 at a desired pressure.

Although the present invention has been described with reference to preferred embodiments, workers skilled in the art will recognize that changes may be made in form and detail without departing from the spirit and scope of the invention. For example, although the cleaning tool has been described as being used with a mobile floor cleaner, those skilled in the art understand that the cleaning tool is operable with other surface cleaning machines configured to provide motorized rotation of the cleaning tool.

What is claimed is:

1. A floor cleaning machine comprising:

a mobile body configured for travel over a surface;

a cleaning tool supported on the mobile body configured to scrub the surface, the cleaning tool comprising:

a hub having a longitudinal axis; and a plurality of cleaning members connected to the hub and distributed along the longitudinal axis, the cleaning members comprising a fibrous material;

a waste container supported on the mobile body and positioned on a rear side of the cleaning tool that is opposite a front side of the cleaning tool;

a housing having a bottom opening through which a portion of the cleaning tool extends, a surround portion substantially conforming to a top side of the cleaning tool, and an opening to the waste container, wherein the cleaning tool is configured to directly release collected debris into the waste container through the opening to the waste container; and a motor supported on the mobile body configured to drive rotation of the hub and the cleaning members about the longitudinal axis such that distal ends of the cleaning members engaging the surface move in a forward direction, which points from the rear side to the front side;

wherein debris, driven from the surface responsive to the rotation of the hub, travels between the hub and the surround portion and is flung in a rearward direction, which is opposite the forward direction, through the opening into the waste container.

2. The machine of claim 1, wherein the hub extends through the cleaning members.

3. The machine of claim 2, wherein the cleaning members are disk-shaped and an outer edge portion of the cleaning members comprises the fibrous material and is configured to flex in response to contact with a surface.

4. The machine of claim 1, further comprising a cleaning liquid dispenser supported on the mobile body and configured to discharge a cleaning liquid onto one of the cleaning tool and the surface.

5. The machine of claim 4, wherein the cleaning liquid dispenser comprises a pump and a supply of cleaning liquid.

6. The machine of claim 1, further comprising a handle extending from the mobile body in a rearward direction, which points from the front side toward the rear side, wherein the motor is configured to drive the rotation of the hub such that distal ends of the cleaning members engaging the surface move in a forward direction, which is opposite the rearward direction.

7. The machine of claim 1, wherein the mobile body does not support a vacuumized waste collection system.

8. The machine of claim 1, wherein a gap between the surround portion of the housing and the top side of the cleaning members is less than 0.3 inches.

9. A floor cleaning machine comprising:

a mobile body configured for travel over a surface;

a cleaning tool supported on the mobile body configured to scrub the surface, the cleaning tool comprising:

a hub having a longitudinal axis; and a plurality of cleaning members connected to the hub;

a cleaning liquid dispenser supported on the mobile body and configured to discharge a cleaning liquid onto one of the cleaning tool and the surface;

a waste container supported on the mobile body and positioned on a rear side of the cleaning tool that is opposite a front side of the cleaning tool;

an operating handle attached to the mobile body on the rear side of the cleaning tool;

a housing having a bottom opening through which a portion of the cleaning tool extends, a surround portion substantially conforming to a top side of the cleaning tool, and an opening to the waste container; and a motor supported on the mobile body drives rotation of the hub and the cleaning members about the longitudinal axis such that distal ends of the cleaning members engaging the surface move in a forward direction, which points from the rear side to the front side;

wherein:

debris, driven from the surface responsive to the rotation of the hub, travels between the hub and the surround portion and is flung in a rearward direction, which is opposite the forward direction, through the opening into the waste container; and the mobile body does not support a vacuumized waste collection system.

10. The machine of claim 9, wherein the cleaning members are disk-shaped.

11. The machine of claim 10, wherein the cleaning members are comprise microfiber.

12. The machine of claim 9, wherein the cleaning liquid dispenser comprises a pump and a supply of cleaning liquid.

* * * * *